US006419473B1

(12) United States Patent
Hawkes

(10) Patent No.: US 6,419,473 B1
(45) Date of Patent: Jul. 16, 2002

(54) APPARATUS FOR CONTINUOUS FRICTION-ACTUATED EXTRUSION

(75) Inventor: Daniel J. Hawkes, Kent (GB)

(73) Assignee: ElectroCopper Products Limited, Mesa, AZ (US)

( * ) Notice: Subject to any disclaimer, the term of this patent is extended or adjusted under 35 U.S.C. 154(b) by 0 days.

(21) Appl. No.: 09/529,295

(22) PCT Filed: Dec. 15, 1999

(86) PCT No.: PCT/US99/29790

§ 371 (c)(1),
(2), (4) Date: Apr. 11, 2000

(87) PCT Pub. No.: WO01/43901

PCT Pub. Date: Jun. 21, 2001

(51) Int. Cl.[7] ..... B22F 3/20

(52) U.S. Cl. ..... 425/79; 72/262; 425/224; 425/382.4; 425/461

(58) Field of Search ..... 425/79, 224, 382.4, 425/461; 72/262

(56) References Cited

U.S. PATENT DOCUMENTS 4,194,841 A 3/1980 Tadmor ..... 366/75
4,329,065 A 5/1982 Hold et al. ..... 366/97
4,484,876 A 11/1984 Childs et al. ..... 425/79

FOREIGN PATENT DOCUMENTS

GB 2 087 301 A 5/1982

*Primary Examiner*—Tim Heitbrink
*Assistant Examiner*—Joseph Leyson
(74) *Attorney, Agent, or Firm*—Mark Kusner; Michael A. Jaffe

(57) ABSTRACT

A continuous, friction-actuated extrusion apparatus, comprised of a cylindrical first member having a circumferential groove formed in its peripheral surface. A stationary second member projects into the groove and defines a passageway between the first member and the second member, the passageway having an entry end and an exit end. A metal feeding device for feeding metal into the passageway at the entry end as the cylindrical first member rotates toward the exit end. An abutment member extends across the passageway at the exit end and at least one die orifice is located at the exit end of the passageway. At least one restriction member is located in the passageway between the orifice and the entry end, the restriction member constricting the passage for a portion thereof.

9 Claims, 8 Drawing Sheets

APPARATUS FOR CONTINUOUS FRICTION-ACTUATED EXTRUSION

FIELD OF THE INVENTION

The present invention relates generally to continuous extrusion of metal, and more particularly to a continuous extrusion machine to produce generally continuous lengths of wire strips and other shapes.

BACKGROUND OF THE INVENTION

In a conventional continuous extrusion process, metal is continuously drawn by friction through a passage to an abutment that obstructs the passage and forces the metal through a die orifice to form a generally continuous extrusion of metal, typically wire. The passage is formed between an annular groove formed in the surface of a rotatable cylindrical die and an arcuate surface of a stationary die. The die orifice is formed in or near the abutment at the end of the passageway. Continuous extrusion machines are typically used for forming copper or aluminum wire (not necessarily round in cross-section).

The present invention relates generally to an improved continuous extrusion machine for extrusion of generally continuous metal shapes from metallic powders, and more particularly for extruding generally continuous shapes from copper powder.

SUMMARY OF THE INVENTION

In accordance with a preferred embodiment of the present invention, there is provided a continuous, friction-actuated extrusion apparatus comprised of a cylindrical first member having a circumferential groove formed in its peripheral surface. A stationary second member projects into the groove and defines a passageway between the first member and the second member, the passageway having an entry end and an exit end. Means for rotating the cylindrical first member are provided such that the first member travels in a direction from the entry end to the exit end of the passageway. A metal feeding device feeds metal into the passageway at the entry end. An abutment member extending across the passageway at the exit end thereof forces the metal powder through at least one die orifice located at the exit end of the passageway. At least one restriction member is located in the passageway between the orifice and the entry end, the restriction member constricting the passage for a portion thereof.

In accordance with another aspect of the present invention there is provided a continuous friction-actuated extrusion apparatus, comprised of a passageway extending from an entry end to an exit end between an arcuate first member and a second member. The second member is in the form of a wheel having circumferential groove formed in its peripheral surface into which groove the first member projects. Means are provided for rotating the wheel in such a direction that those surfaces of the passageway constituted by the groove travel from the entry end towards the exit end. Metal feed means for feeding metal into the passageway are provided at the entry end. At least one die orifice is located in or adjacent to an abutment member extending across the passageway at the exit end thereof for extrusion of material from the passageway.

At least one restriction is formed in the passageway between the die orifice and the entry end of the passageway. The restriction reduces the average cross-sectional area of the passageway by at least 40%.

It is an object of the present invention to provide a continuous extrusion machine for continuous, friction actuated extrusion of metal from metal powders.

Another object of the present invention is to provide a machine as described above for extrusion of copper wire from copper powder.

Another object of the present invention is to provide a machine as described above that reduces internal stresses within the formed wire.

A still further object of the present invention is to provide a machine as described above that provides a pre-extrusion process prior to extrusion at the forming die.

These and other objects and advantages will become apparent from the following description of a preferred embodiment of the present invention, taken together with the accompanying drawings.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
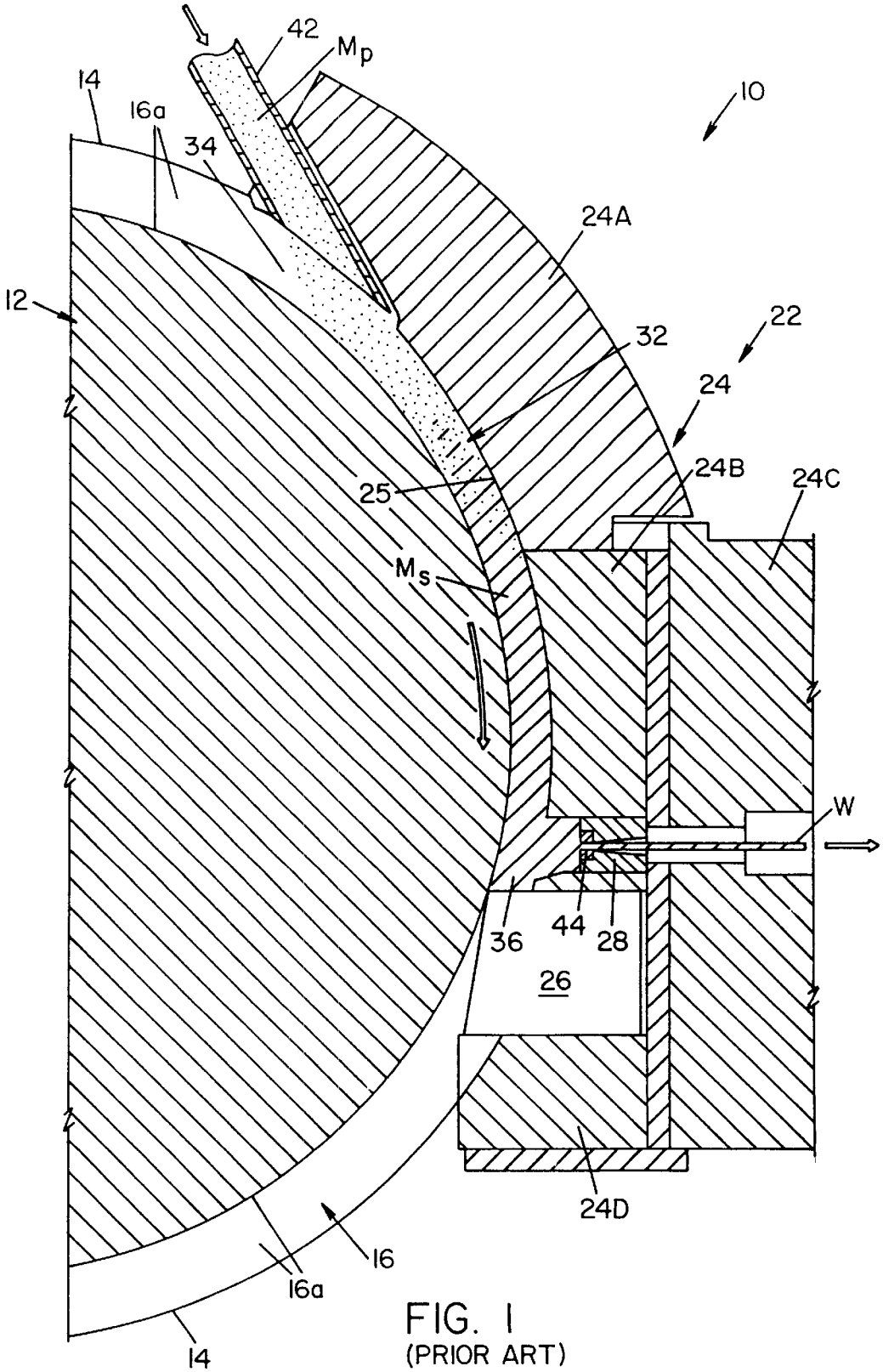
FIG. 1 (PRIOR ART)
FIG. 1 is a fragmentary view of a conventional continuous extrusion machine showing in cross-section a portion of the wheel, the stationary die and the abutment.

Referring now to the drawings wherein the showings are for the purpose of illustrating a preferred embodiment of the invention only, and not for the purpose of limiting same, FIG. 1 shows a portion of a conventional continuous extrusion machine 10. Continuous extrusion machine 10 includes a relatively large wheel 12 having an outer cylindrical surface 14. Wheel 12 is rotatable about an axis by a drive assembly (not shown). In the drawings, wheel 12 is shown being rotatable in a clockwise direction. A groove 16 is formed in surface 14 about the periphery of wheel 12.

A stationary die assembly 22 is disposed adjacent to wheel 12. Die assembly 22 is generally comprised of a shoe 24, an abutment 26 and a die 28. In the embodiment shown, shoe 24 is comprised of a plurality of segments designated 24A, 24B, 24C and 24D. A portion of shoe 24 is disposed within groove 16 as best-illustrated in FIGS. 5–9. A passageway 32 is defined between wheel 12 and shoe 24. Passageway 32 is defined by a surface 16a of groove 16 and by a surface 25 defined by shoe 24. In conventional continuous extrusion machines, shoe 24 is shaped such that the cross-sectional area of passageway 32 becomes gradually smaller in the direction of rotation of wheel 12. The end of passageway 32 with the larger cross-sectional opening defines an entry end, designated 34 in the drawings, for receiving metal as shall hereinafter be described. An exit end 36 of passageway 32 is defined by abutment 26. Abutment 26 is dimensioned to project into groove 16 and to substantially match the cross-section thereof. At entry end 34 of passageway 32 a chute 42 is disposed to intersect groove 16. Chute 42 is connected to a metal feed assembly (not shown) to provide metal into groove 16, as is conventionally known in the conforming art.

Die 28 is disposed at exit end 36 of passageway 32. Die 28 includes a die orifice 44 extending therethrough. Die orifice 44 defines the cross-sectional shape of the generally continuous strip or wire to be formed by continuous extrusion machine 10. In the embodiment shown. die orifice 44 is orientated radially to wheel 12. It is of course appreciated that die orifice 44 may alternately be formed through abutment 26. Continuous extrusion machine 10 as described heretofore is typical of continuous extrusion machines known heretofore.

Figure 2:
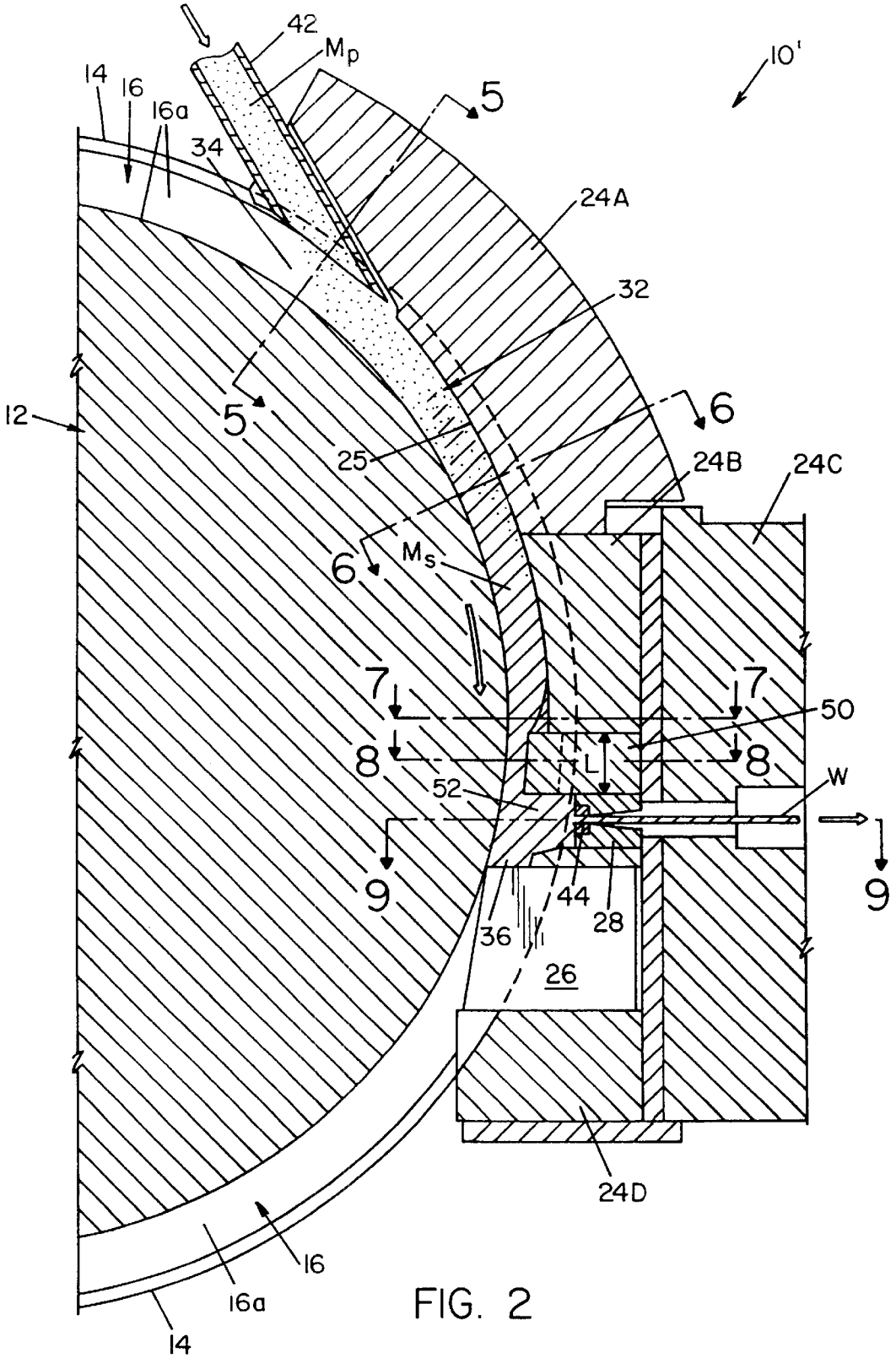
FIG. 2 is an enlarged sectional view of a continuous extrusion machine illustrating a preferred embodiment of the present invention.

Referring now to FIG. 2. a continuous extrusion machine designated 10' illustrating a preferred embodiment of the present invention is shown. Continuous extrusion machine 10' is like continuous extrusion machine 10 in all respects with the exception that a restriction member 50 is disposed within passageway 32. Restriction member 50 is located between die orifice 44 and entry end 34 of passageway 32. Restriction member 50 is provided to significantly constrict, i.e.. reduce, the cross-sectional area of passageway 32 for a specific length designated "L." In accordance with the present invention, restriction member 50 preferably reduces the cross-sectional area of passageway 32 immediately preceding restriction member 50 by at least 30%, and more preferably by about 40% to about 60%, most preferably by about 50%. Length L is preferably about 15 mm to about 20 mm and more preferably about 17 mm. Restriction number 50 is preferably located near die orifice 44 and more preferably immediately preceding die orifice 44. Restriction member 50 defines a chamber 52 that is bounded by wheel 12, abutment 26, die 28 and restriction member 50.

Figure 3:
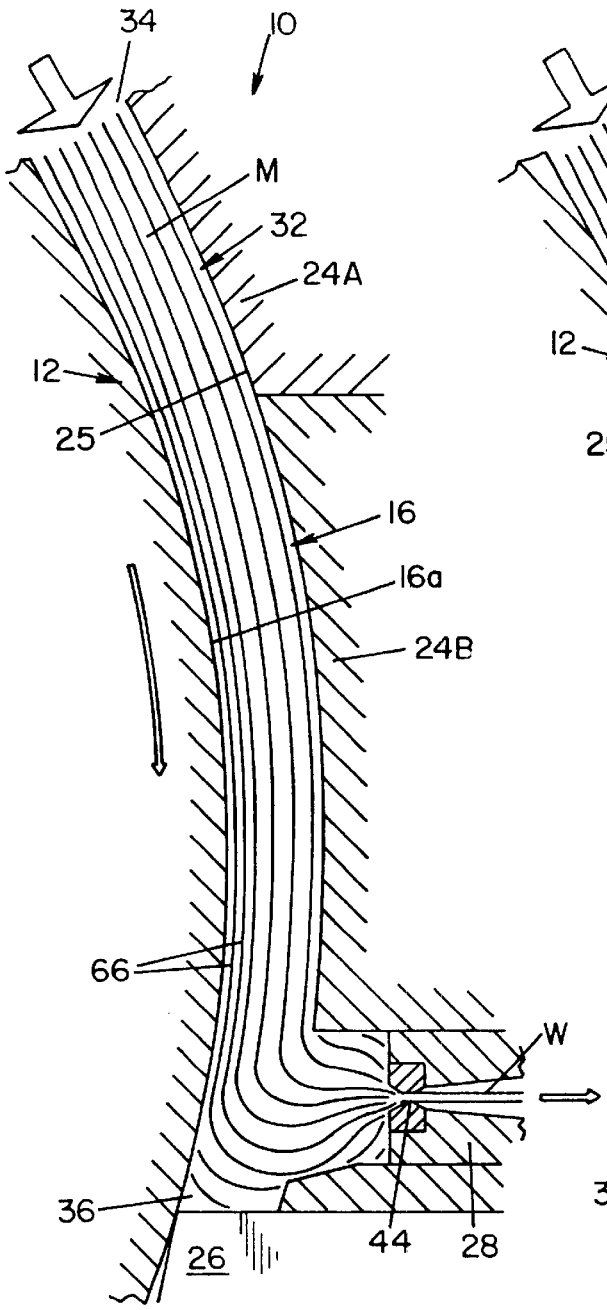
FIG. 3 (PRIOR ART)
FIG. 3 is an enlarged sectional view of the continuous extrusion machine shown in FIG. 1 schematically illustrating the flow of metal therethrough.
Figure 4:
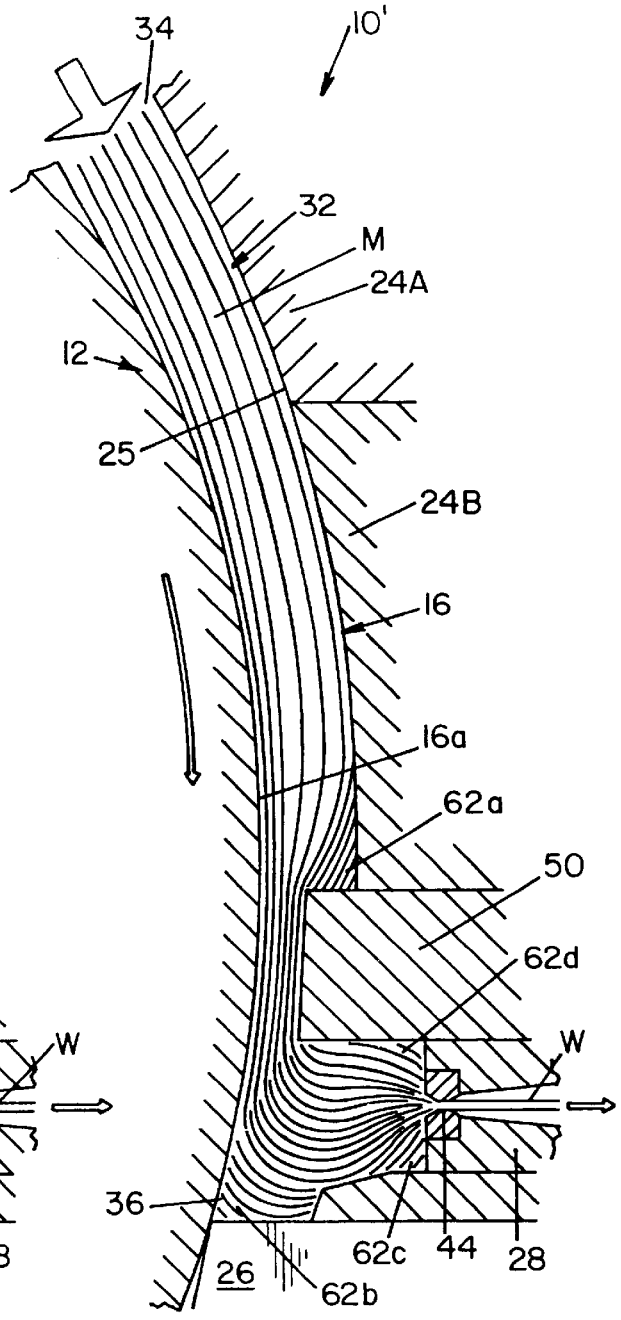
FIG. 4 is an enlarged sectional view of the continuous extrusion view shown in FIG. 2 schematically illustrating the flow of metal therethrough.

Referring now to FIGS. 3 and 4, the operation of continuous extrusion apparatus 10', and more specifically, restriction member 50, shall be described. The invention shall be described by contrasting the operation of continuous extrusion machine 10' to the operation of a conventional continuous extrusion machine 10, as shown in FIG. 1. In continuous extrusion machine 10, metal powder, designated $M_p$, is fed into groove 16 via chute 42 as wheel 12 rotates past chute 42. In the drawings, metal powder $M_p$ is schematically illustrated by "flecks" or "peppering" in chute 42 and passage 32. Metal powder $M_p$ is dragged by friction between moving surface 16*a* of groove 16 and surface 25 of shoe 24 toward abutment 26. As the opening of passageway 32 gradually decreases the cross-section, metal powder $M_p$ is compressed as it is dragged toward abutment 26. The particulate metal powder $M_p$ is drawn through passageway 32 under a continuous metal drag force until it reaches the end of passageway 32 and is forced through die orifice 44 to form a generally continuous wire. As metal powder $M_p$ is dragged along passageway 32, it begins to change from a powder form to a more solid-like mass of metal. In the drawings, the more solid-like mass of metal is schematically illustrated in the drawing using conventional cross hatching and is designated $M_s$.

Though metal powder $M_p$ and melted solid $M_s$ do not melt, it is believed that the flow of metal can be modeled as a fluid using well-established principles of fluid L mechanics. In this respect, it is believed that the metal particulate $M_p$ and semi-solid metal $M_s$ in contact with, and nearest to, the surface 16*a* of groove 16 has a higher speed through passageway 32 than does the metal powder in contact with stationary surface 25 of shoe 24. As a result, a non-uniform laminar flow is believed to exist near die orifice 44, as illustrated in FIG. 3, where flow lines 66 schematically show how the metal near the surface of wheel 12 is forced into abutment 26 and then directed toward die orifice 44 while the metal near stationary surface 25 of shoe 24 moves more slowly toward die orifice 44. It is believed at the point where frictional bonding of the metal powder has begun the faster and slower moving metal particulate create internal stresses within the extruded wire, particularly for certain cross-sectional shapes such as rectangular wire. These inherent stresses produce a weak stress plane along the axis of the wire.

Referring now to FIG. 4, a metallic flow pattern for continuous extrusion machine 10' is schematically shown. As illustrated in FIG. 4, the cross-sectional area of passageway 32 is significantly reduced by restriction member 50 forcing the metal through a smaller passage defined between the surface of restriction member 50 and surface 16*a* of groove 16. As a result, a number of events are believed to occur. First, metal powder $M_p$ is compacted and becomes denser as it is forced through the smaller cross-sectional opening defined by restriction member 50. Second, the velocity of the metal increases, and more importantly the velocity differential between the metal is reduced in that the space between moving surface 16*a* of groove 16 and the stationary surface of restriction member 50 are reduced. In addition, the velocity of the metal is increased by the very fact that the equation of continuity requires a higher velocity for the material to pass through the reduced cross-sectional area defined by restriction member 50. Third, the increase in velocity produces a more uniform laminar flow through the constricted portion of passageway 32. As a result, it is believed that a preliminary extrusion takes place as the metal is forced through the reduced passageway defined between restriction member 50 and surface 16*a* of groove 16. It is further believed that the metal begins to fuse together to form a somewhat continuous mass that is diverted and directed by abutment 26 through die orifice 44.

As schematically illustrated in FIG. 4, in corners or pockets, such as these designated 62*a*, 62*b*, 62*c* and 62*d*, the metal will naturally build up and become stationary. In such areas a natural contour will develop to direct the metal past restriction member 50 and toward and through die orifice 44.

Figure 5:
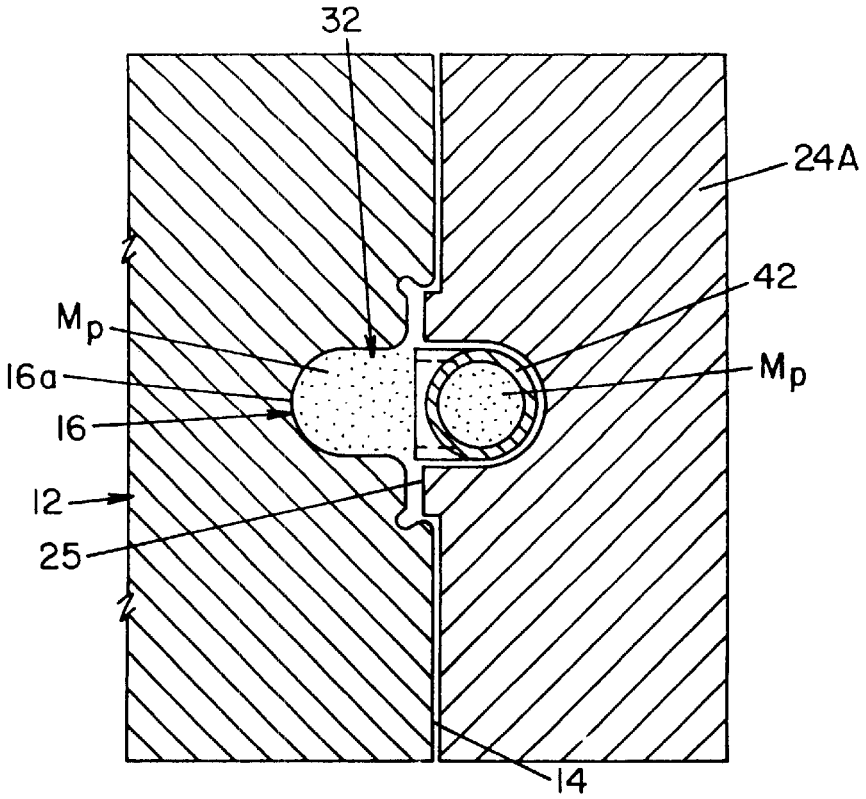
FIG. 5 is an enlarged sectional view taken along lines 5—5 of FIG. 2.
Figure 6:
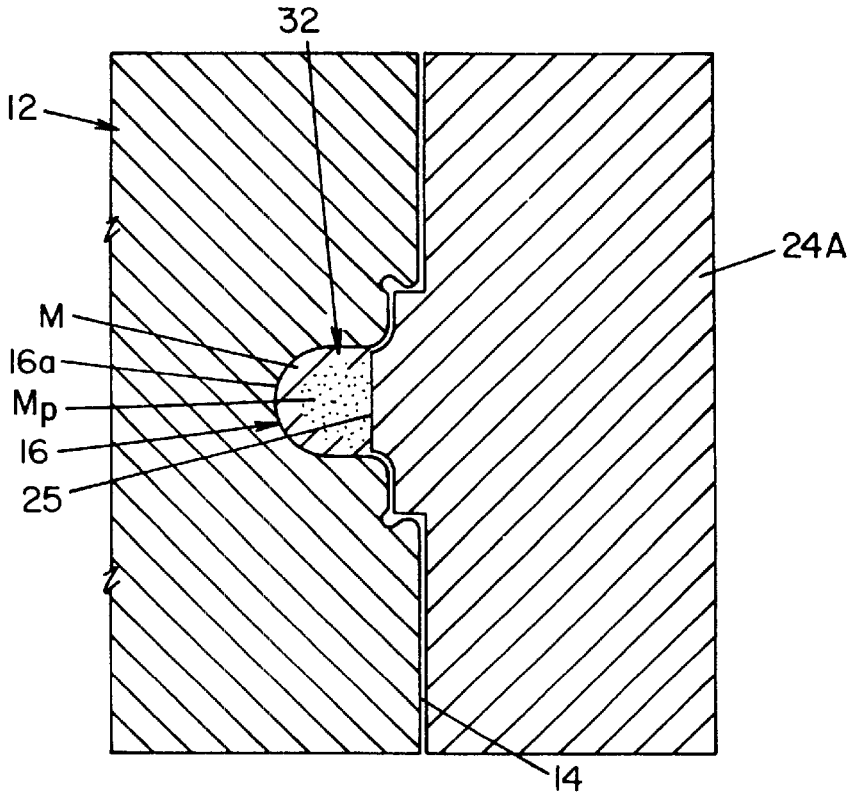
FIG. 6 is an enlarged sectional view taken along lines 6—6 of FIG. 2.
Figure 7:
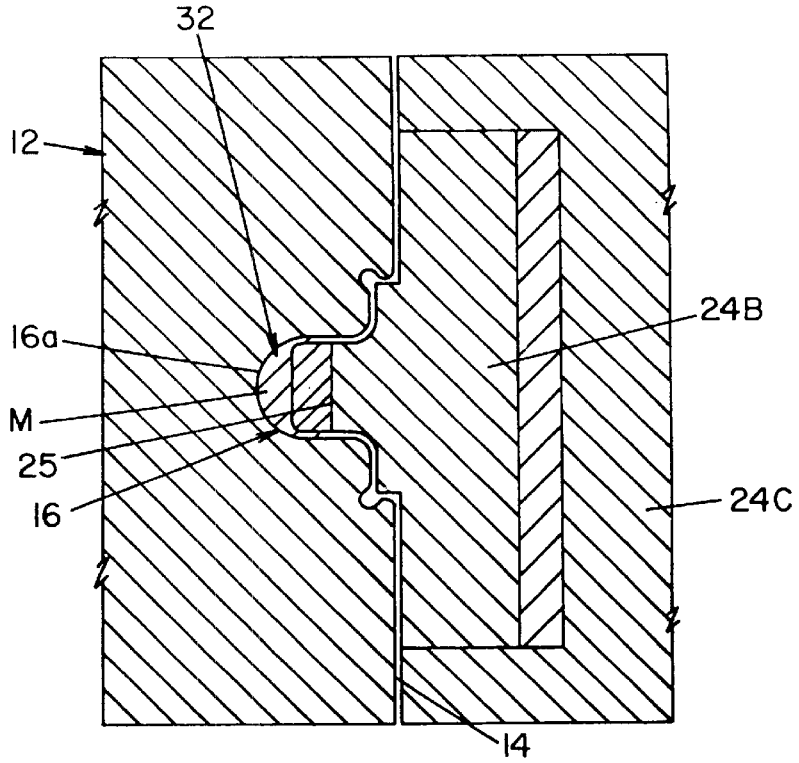
FIG. 7 is an enlarged sectional view taken along lines 7—7 of FIG. 2.
Figure 8:
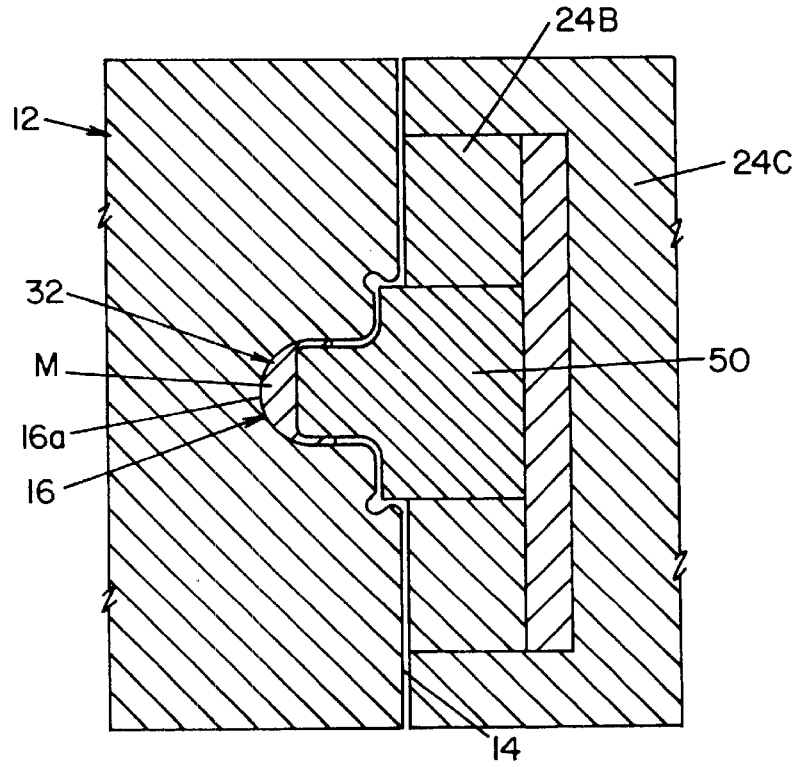
FIG. 8 is an enlarged sectional view taken along lines 8—8 of FIG. 2.

FIGS. 5 through 9 schematically illustrate the transition of metal powder $M_p$ to a generally continuous wire W. FIG. 5 shows metal powder $M_p$ disposed in passageway 32. As the opening of passageway decreases in the direction of rotation of wheel 12, metal powder $M_p$ begins to fuse together under the pressure and frictional heat generated by the metal powder being dragged down passageway 32. FIG. 6 shows a cross-section through passageway 32 about midway between entry end 34 and exit end 36. As schematically illustrated in FIG. 6, the metal has begun to solidify into an extrudable solid mass (as indicated by "crosshatching") near the surface of groove 16 of wheel 12 and generally remain a powder (as indicated by "peppering") near the stationary surface of shoe segment 24A. FIGS. 7 and 8, respectively, show metal M immediately preceding and adjacent restriction member 50. At these locations, it is believed that metal M is essentially a solid, but extrudable, mass. Forcing the metal past restriction member 50 significantly compresses the metal, and as suggested above temporarily increases the speed of the metal.

Figure 9:
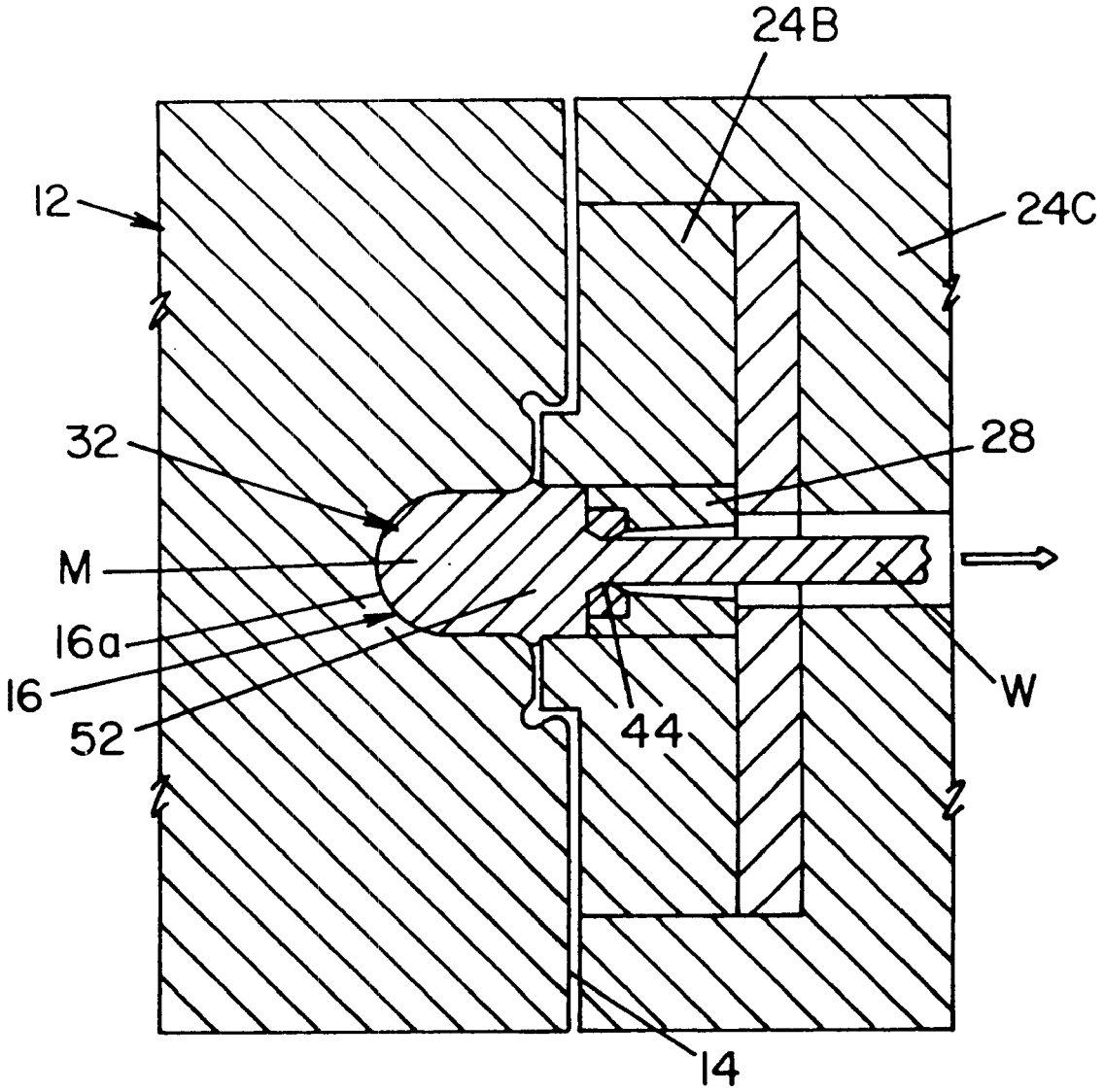
FIG. 9 is an enlarged sectional view taken along lines 9—9 of FIG. 2.

The compressed metal is forced into cavity 52 that precedes die orifice 44. It is believed that in this area the metal is a solid, but extrudable mass, that is extruded through die orifice 44 into wire W by the pressure created by wheel 12, as illustrated by FIG. 9. It is believed that the metal forced past restriction member 50 has a more uniform temperature, velocity and compaction as it enters cavity 52 immediately preceding die orifice 44. It is also believed that restriction member 50 creates a preliminary extrusion process that compacts the metal prior to its ultimate extrusion into wire W through die orifice 44.

The foregoing explanation is based upon a belief as to what occurs as a result of the presence of restriction member 50 in passageway 32. Regardless of the actual events caused by restriction member 50, the use of such member results in an enhancement in the quality of wire formed.

The invention shall now be further described together with the following example wherein a wire formed by a conventional continuous extrusion machine 10 without restriction members 50 is contrasted to a wire form by the same continuous extrusion machine having restriction member 50 disposed in passageway 32.

EXAMPLE

A test is conducted to contrast wire formed by a conventional continuous extrusion machine 10 with wire formed in the same continuous extrusion machine but including restriction member 50. In the tests. a BWE continuous extrusion machine was used under the same operating conditions. using a die 28 having the same die orifice 44. Restriction member 50 is a rectangular block that reduces the cross-sectional area of passageway 32 by about 50%. In both tests, a 0.197 by 0.079 rectangular copper w ire was formed from copper powder having a $D_{50}$ particle size of about 200 Mesh (Tyler).

Table 1 shows the operating characteristics of the continuous extrusion machine when used with and without restrictive member 50.

TABLE 1

OPERATING CHARACTERISTICS

| | Continuous Extrusion Machine w/o Restriction Member | Continuous Extrusion Machine with Restriction Member |
|---|---|---|
| Wheel Speed | 3.5 rpm | 3.5 rpm |
| Actual Product Speed | 16 m/min (±3 m/min) | 12 m/min (±3 m/min) |

Table 2 shows the physical properties of wire formed using the continuous extrusion machine 10 without restriction member 50 and wire formed by the continuous extrusion machine 10' using restriction member 50.

TABLE 2

PHYSICAL CHARACTERISTICS OF WIRE PRODUCT

| | Continuous Extrusion Machine w/o Restriction Member | Continuous Extrusion Machine with Restriction Member |
|---|---|---|
| Ultimate Tensile Strength | 34.1 ksi | 34.4 ksi |
| .2% Yield Strength | 24.1 ksi | 15.3 ksi |
| Total % Elongation | 28.5% | 48.5% |
| # of Surface Defects | 624 eddy current count | 125 eddy current count |

The results show significant improvements in the quality and properties of wire formed with restriction member 50 in passageway 32 as compared to wire formed without a restriction in passageway 32. Specifically. Table 2 shows only a slight difference in tensile strength between the two wires. but shows a dramatic difference in both the yield strength and elongation properties between the two wires. The lower yield strength and higher elongation are both desirable characteristics in wire of the type disclosed that is typically used in motor pole windings. More importantly, however, wire formed with modified machine 10' showed significantly less surface defects as measured by a conventional eddy current technique.

The present invention thus provides a method of improving the properties of wire formed from metal particulate, and in particular copper powder by inserting a restriction member 50 within a passageway of a conventional continuous extrusion machine. It is believed that restriction member 50 produces a first extrusion process within passageway 32 that provides a preliminary compression and bonding of the copper particulate. On information and belief. this preliminary extrusion produces a generally more compact stream of copper that is directed toward die orifice 44 to provide a continuous wire with more desirable properties.

Figure 10:
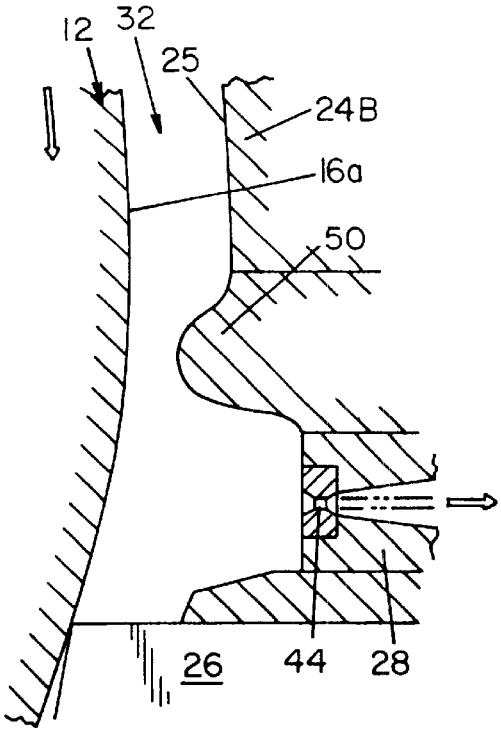
FIGS. 10–15 are side elevational views of restriction members illustrating alternate shapes.
Figure 11:
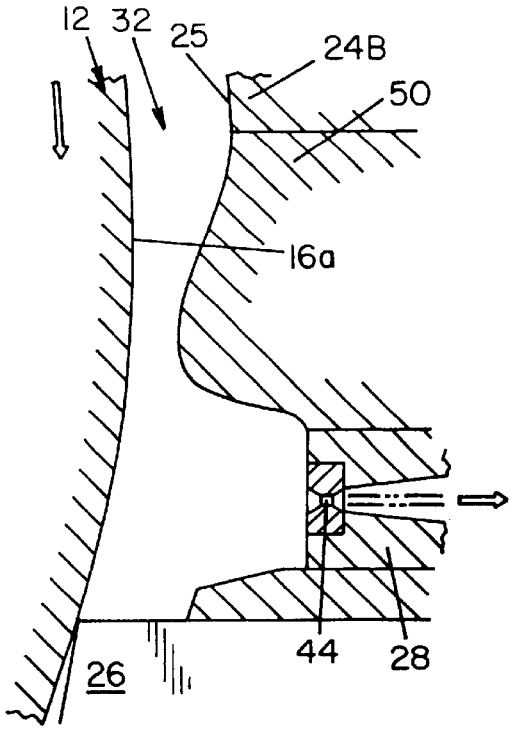
Figure 12:
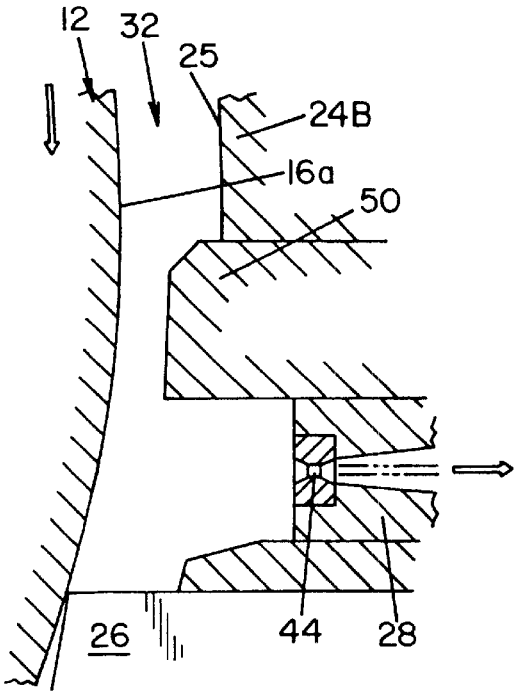
Figure 13:
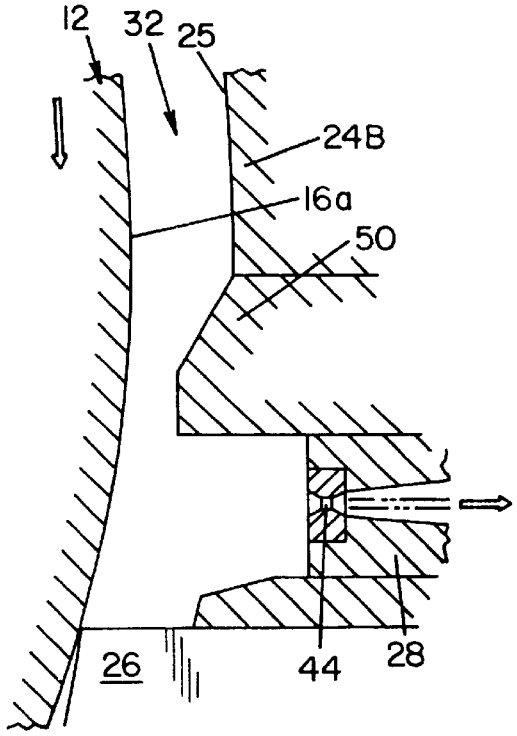
Figure 14:
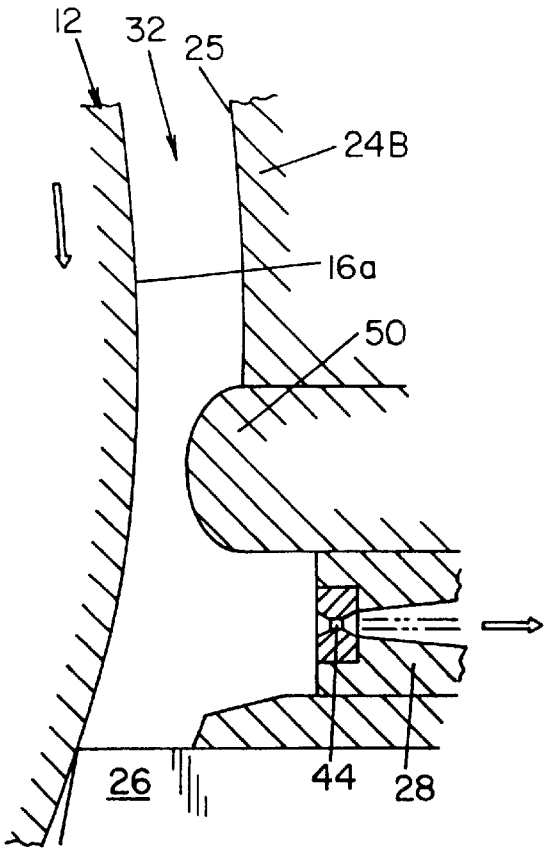
Figure 15:
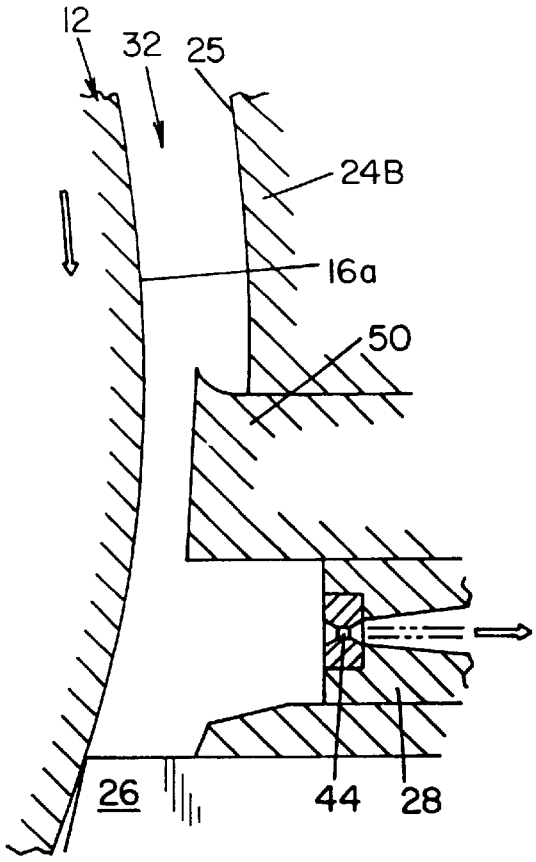

The foregoing description discloses a restriction member 50 of a specific rectangular shape. It is believed that other shapes may likewise produce the desired end results. For example, it was found that using the rectangular restriction member 50 produced a dead zone of built-up or packed copper at the leading end of restriction member 50. In other words. the copper powder built a corner or fillet, and produced a region of stagnant stationary copper that formed a ramp that generally directed the metallic powder into the reduced passageway between restriction member 50 and groove 16. It is therefore believed that restriction members having a taper or chamfered leading end may provide more uniform laminar flow of the metal particulate into the restricted metal passageway. FIGS. 10 through 15 thus show alternate configurations for restriction member 50. Specifically FIGS. 10 and 11 show restriction members 50 that have a contoured leading edge to guide metal M into the restriction. FIGS. 12 and 13 show restriction members 50 with chamfered and tapered leading edges. FIGS. 14 and 15 show still other embodiments for forming a restriction in passageway 32.

The foregoing description is a specific embodiment of the present invention. It should be appreciated that this embodiment is described for purposes of illustration only. and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A continuous, friction-actuated extrusion apparatus, comprised of:

a cylindrical first member having a circumferential groove formed in its peripheral surface;

a stationary second member projecting into said groove;

a passageway defined between said first member and said second member, said passageway having an entry end and an exit end;

means for rotating said cylindrical first member such that said first member travels in a direction from said entry end to said exit end;

a metal feeding device for feeding metal into said passageway at said entry end;

an abutment member extending across said passageway at said exit end thereof;

at least one die orifice located at said exit end of said passageway; and at least one restriction member located in said passageway immediately preceding said orifice, said restriction member reducing the cross-sectional area of said passageway immediately preceding said restriction member by at least 40%.

2. An apparatus as defined in claim 1, wherein said first member and said second member define a generally arcuate passageway.

3. An apparatus as defined in claim 2, wherein said passageway has a generally uniform cross-sectional shape.

4. An apparatus as defined in claim 3, wherein said restriction member modifies the cross-sectional shape of said passageway for a portion of said passageway.

5. An apparatus as defined in claim 3, wherein said restriction member extends across said passageway.

6. An apparatus as defined in claim 1, wherein said restriction member is substantially rectangular in cross-section.

7. An apparatus as defined in claim 1, wherein said restriction member has a tapered leading edge and a tapered trailing edge in the direction of rotation of said first member.

8. A continuous friction-actuated extrusion apparatus, comprising:

a passageway extending from an entry end to an exit end between an arcuate first member and a second member, said second member being in the form of a wheel having a circumferential groove formed in its peripheral surface into which groove the first member projects;

means for rotating the wheel in such a direction that those surfaces of the passageway constituted by the groove travel from the entry end towards the exit end;

means for feeding metal into the passageway at the entry end;

at least one die orifice located in or adjacent to an abutment member extending across the passageway at the exit end thereof for extrusion of material from the passageway;

at least one restriction formed in said passageway between said die orifice and said entry end of said passageway, said restriction being disposed in said passageway immediately preceding said die orifice and reducing the average cross-sectional area of said passageway by at least 40%.

9. An apparatus as defined in claim 8, wherein said restriction in said passageway increases the velocity of said metal through said restriction.

* * * * *